US007836924B2

(12) United States Patent
Park et al.

(10) Patent No.: US 7,836,924 B2
(45) Date of Patent: Nov. 23, 2010

(54) METHODS FOR ENHANCING HARDNESS AND DIMENSIONAL STABILITY OF A WOOD ELEMENT AND WOOD PRODUCT HAVING ENHANCED HARDNESS

(75) Inventors: David W. Park, Puyallup, WA (US); Ronald C Wilderman, Sumner, WA (US)

(73) Assignee: Weyerhaeuser NR Comp½any, Federal Way, WA (US)

( * ) Notice: Subject to any disclaimer, the term of this patent is extended or adjusted under 35 U.S.C. 154(b) by 169 days.

(21) Appl. No.: 12/355,640

(22) Filed: Jan. 16, 2009

(65) Prior Publication Data

US 2010/0180987 A1 Jul. 22, 2010

(51) Int. Cl.
*B27M 1/08* (2006.01)

(52) U.S. Cl. ..... 144/364; 144/380

(58) Field of Classification Search ..... 144/259–361, 144/363, 364, 380

See application file for complete search history.

(56) References Cited

U.S. PATENT DOCUMENTS

| | | | | |
|---|---|---|---|---|
| 1,480,658 | A * | 1/1924 | Bostock | 12/133 M |
| 1,952,664 | A * | 3/1934 | Esselen | 144/380 |
| 5,343,913 | A * | 9/1994 | Tanahashi et al. | 144/380 |
| 5,937,925 | A * | 8/1999 | Lee | 144/380 |
| 5,992,043 | A * | 11/1999 | Guyonnet | 34/382 |
| 6,395,204 | B1 * | 5/2002 | Neogi et al. | 264/37.1 |
| 7,404,422 | B2 | 7/2008 | Kamke et al. | |
| 2005/0006004 | A1 | 1/2005 | Kamke et al. | |

FOREIGN PATENT DOCUMENTS

| | | |
|---|---|---|
| CN | 1586841 | 3/2005 |
| JP | 7001413 | 1/1995 |
| JP | 8252809 | 10/1996 |
| JP | 9155814 | 6/1997 |
| JP | 24345183 | 12/2004 |
| WO | 0013866 | 3/2000 |

OTHER PUBLICATIONS

Welzbacher, C.R, et al., "Thermo-mechanical densification combined with thermal modification of Norway Spruce (Picea abies Kart) in industrial scale—Dimensional stability and durability aspects", Springer, online Sep. 9, 2007.

"ThermoWood (R) Handbook", Finish Thermowood Association, Aug. 2003.

(Continued)

*Primary Examiner*—Shelley Self
(74) *Attorney, Agent, or Firm*—Rachael Vaughn

(57) ABSTRACT

The present disclosure includes methods for enhancing hardness and dimensional stability of a wood element. In one embodiment, the method includes placing the wood element in a compression assembly set to a compression temperature between about 365° F. and about 410° F., heating and compressing the wood element without exceeding the species' threshold pressure value to produce a compressed wood product, heating the compressed wood product to a post-compression temperature between about 275° F. and about 350° F., and holding the compressed wood product at the post-compression temperature for about 30 to about 48 hours. The disclosure also includes a wood product having enhanced hardness.

10 Claims, 8 Drawing Sheets

OTHER PUBLICATIONS

Seborg, R.M., et al., "Heat-Stabalized Compressed Wood (Staypack)", U.S. Department of Agriculture, Forest Service, No. 1580, Mar. 1956.

"Wood Handbook—Basic Information on Wood as a Material of Construction with Data for Its Use in Design and Specification", 1955, Agriculture Handbook No. 72, US Department of Agriculture, The Forest Products Laboratory.

"NanoWood: Multifunctional timber facade system made from finished thermo-wwod for sustainable building facades", PROFACTOR, online Jul. 2005.

Gopu, Vijaya K.A., "Some Structural Properties of Densified Veneer Wood", Proceedings of the International Wood Engineering Conference, vol. 2, Oct. 1996, New Orleans, Louisiana.

"Case Hardening in Timber", The Australian National University, on line Dec. 2004.

Zhao, Guang-Jie, et al., "Technology of Improving the Surface of Hardness of China Fir (*Cunninghamia lanceolata*) and its Deform Fixation" International Conference on Effective Utilization of Plantation Timber, May 1999, Chi-Tou, Taiwan, China.

Tomme, Francois-Ph, et al., "Densified Wood; an Innovative Product with Highly Enhanced Characters", 5th World Conference on Timber Engineering, Aug. 1998, Montreux, Switzerland.

Navi, Parviz, et al., "Effects of Thermo-Hydro-Mechanical Treatment on the Structure and Properties of Wood", Holzforschung, vol. 54, 2000, No. 3.

O'Neill, Graeme, "Microwave processing to reshape timber industry" UniNews vol. 13, No. 17, Sep. 2004.

Ranta-Manus, Alpo, et al., Analysis of Case Hardening, Finland, known to Applicant prior to Applicant's filing date (Jan. 16, 2009).

"Vintorg, a new modified wood product," CRC Wood Innovation, The University Of Melbourne, Parkville, Victoria, known to Applicant prior to Applicant's filing date (Jan. 16, 2009).

* cited by examiner

METHODS FOR ENHANCING HARDNESS AND DIMENSIONAL STABILITY OF A WOOD ELEMENT AND WOOD PRODUCT HAVING ENHANCED HARDNESS

TECHNICAL FIELD

The present disclosure relates to methods for enhancing the hardness of a wood element and a wood product having enhanced hardness. More specifically, the disclosure relates to producing a wood product having enhanced hardness and dimensional stability without the use of a chemical component or chemical process.

BACKGROUND

Increasingly widespread utilization of forest resources has led to a scarcity of old-growth timbers in many parts of the world. Old-growth timber is particularly valuable because it generally contains a higher percentage of "mature" wood per unit volume. In contrast, timber from plantations or other environments in which trees are urged to reach a harvestable size as soon as possible generally has a higher percentage of "juvenile" wood per unit volume. Lumber having a greater percentage of mature wood tends to be harder than lumber having a greater percentage of juvenile wood. For example, FIG. 1 shows a comparison between the hardness of maple (an old-growth wood or a naturally hard wood) and alder based. In addition to old-growth timber, there are other types of timber that are naturally hard. Hardness is an important mechanical property for many applications including the manufacture of cabinets, flooring, furniture, decorative objects, and other products using wood as a material. Thus, old-growth timber or naturally hard timber is in high demand.

In addition to hardness, a number of other mechanical and aesthetic properties are desirable for the applications listed above. For example, a wood that is used for flooring material should be able to withstand exposure to water or humidity without significant swelling or shrinkage. The wood's ability to be stained or varnished (refinishability) is also important for many applications. Abrasion resistance, workability, and color modification are also desired characteristics.

Due to the shortage of old-growth timber and other naturally hard timber, the industry has developed numerous methods for treating available wood with inadequate properties to make it more closely resemble those of old-growth timber and naturally hard timber. Many of these treatment methods are concerned with increasing hardness. Altering the hardness of wood generally involves increasing the wood's density through either chemical or mechanical means.

Chemical methods for increasing wood density often involve impregnating the wood with polymers, resins, waxes, or other chemical treatments to fill voids in the structure. One such method is used widely to create a product known in the industry as "compreg" or compressed and impregnated wood. See Stamm, A. J., R. M. Seborg, 1941, Resin treated, laminated, compressed wood, Trans. Am. Inst. Chem. Eng., 37:385-397. The method involves treating solid wood or veneer with water-soluble phenol formaldehyde resin and compressing it to a desired specific gravity and thickness. One drawback of this method is that the chemicals used in this and other chemical hardness enhancing processes pose a number of health, safety, and environmental risks. Acquiring the equipment and facilities to perform such a procedure may also be more expensive than buying highly priced old-growth timber or naturally hardwood with adequate mechanical properties. In some cases, the chemicals themselves be a large portion of this cost. Additionally some resins used for impregnation has a dark brown color which affects the appearance of the final product as well as its ability to accept a varnish or stain.

Mechanical methods for increasing wood density generally involve redistributing lignin throughout the wood's structure. Wood is composed of essentially three components: cellulose, hemicellulose, and lignin. Lignin a group of phenolic polymers that confer strength and rigidity to the woody cell wall of plants. Thus, redistributing lignin throughout the wood can increase its overall strength.

U.S. Pat. No. 2,453,679 discloses a mechanical method for compressing a wood to cause lignin to flow within the structure. According to the disclosure, the method involves compressing a wood having a moisture content between 6% and 12% in a press set to an initial temperature between 210° F. and 240° F. The wood is compressed to a specific gravity of 1.3-1.4, and then the press is adjusted to a temperature between 330° F. and 360° F. The wood is held at this temperature for 5 to 30 minutes while pressure is maintained. Thereafter the wood is cooled under pressure to a temperature of 200° F. or lower before removal from the press. One drawback of this method is that if the wood is removed before it is completely cooled, it will tend to undergo "springback" or recovery from compression when exposed to moisture. In addition, density changes in the wood tend to not be uniform, leaving end pieces that must be trimmed away because they are lighter in color and more unstable than the rest of the wood.

U.S. Pat. No. 7,404,422 discloses another mechanical method for densifying wood components known as "viscoelastic thermal compression." The method involves heating and conditioning wood to its glass transition temperature and subsequently compressing the wood. After compression, an annealing process is performed which involves holding the wood at a pressure between 2000 kPa and 4000 kPa and a temperature between 350° F. and 440° F. for about 60 to 120 seconds. After annealing the wood is cooled below the glass transition temperature. One drawback of this method is that heating to a temperature over 400° F. can actually cause the lignin to decompose. Another drawback is that although the process can increase density of the wood, the increase is not always uniform. Additionally the high heat can scorch the wood, thus adversely affecting its aesthetic appearance and coloring.

Thus, there is a need to develop a method for enhancing the hardness and dimensional stability of wood in a manner that preserves the color and appearance of the wood for applications where aesthetics are an important factor. There is also a need to enhance the hardness of wood by causing a uniform increase in density. It would also be an improvement to develop such a process that can be implemented using conventional equipment at minimal cost. There is also a need to develop a method for enhancing hardness that also has a desirable effect on other wood properties such as abrasion resistance, refinishability, workability, and color modification.

SUMMARY

The following summary is provided for the benefit of the reader only and is not intended to limit in any way the invention as set forth by the claims. The present disclosure is directed generally towards enhancing the hardness of a wood element. More specifically, the disclosure is directed to methods for enhancing the hardness of wood without using a chemical component or chemical process.

In one embodiment, a wood element is placed in a compression assembly set to a compression temperature between about 365° F. and about 410° F. The compression assembly is operated to compress and heat the wood element to a desired densification target without exceeding a threshold pressure value based on the species of wood to which the wood element belongs. The compression stage produces a compressed wood product. The compressed wood product is then heated to a post-compression temperature between about 275° F. and about 350° F. and held at this temperature for about 30 to about 48 hours. The combination of these procedures ensures that lignin, resins, moisture and other natural thermoplastics in the wood element are able to migrate throughout the structure and enhance strength by permanently retaining the increased density. The method does not require adding chemicals or performing chemical treatments.

In another embodiment, the method can include conditioning a wood element to produce a moisture content of about 8% to about 15%. After conditioning, the wood element is placed in a compression assembly set to a compression temperature between about 365° F. and about 410° F. and compressed to produce a compressed wood product. This is done by reducing the caliper of the wood element while simultaneously applying pressure and increasing the wood element's core temperature. The compressed wood product is subsequently removed from the compression assembly and heated to a temperature between about 275° F. and about 350° F. without applying pressure. The compressed wood product is held at this temperature for about 30 to about 48 hours to produce a wood product having enhanced hardness.

Further aspects of the disclosure are directed towards a wood product having enhanced hardness made by first conditioning a wood element to obtain a moisture content of about 8% to about 15%. After conditioning, the wood element is placed in a compression assembly set to a compression temperature between about 365° F. and about 410° F. The wood element is compressed without exceeding a threshold pressure value to produce a compressed wood product. Subsequently the compressed wood product is heated to a post-compression temperature between about 275° F. and about 350° F. for about 30 to about 48 hours to produce a wood product having enhanced hardness.

BRIEF DESCRIPTION OF THE DRAWINGS

The present disclosure is better understood by reading the following description of non-limitative embodiments with reference to the attached drawings wherein like parts of each of the figures are identified by the same reference characters, and are briefly described as follows.

Certain specific details are set forth in the following description and FIGS. 1-8 to provide a thorough understanding of various embodiments of the disclosure. Well-known structures, systems, and methods often associated with such systems have not been shown or described in details to avoid unnecessarily obscuring the description of various embodiments of the disclosure. In addition, those of ordinary skill in the relevant art will understand that additional embodiments of the disclosure may be practiced without several of the details described below.

In this disclosure the term "wood" or "wood element" is used to refer to any organic material produced from trees, shrubs or the like. In addition, the terms "wood" and "wood element" may also refer to processed wood elements such as wood composites (e.g., oriented strand board). The disclosure is not intended to be limited to a particular species or type of wood.

Figure 1:
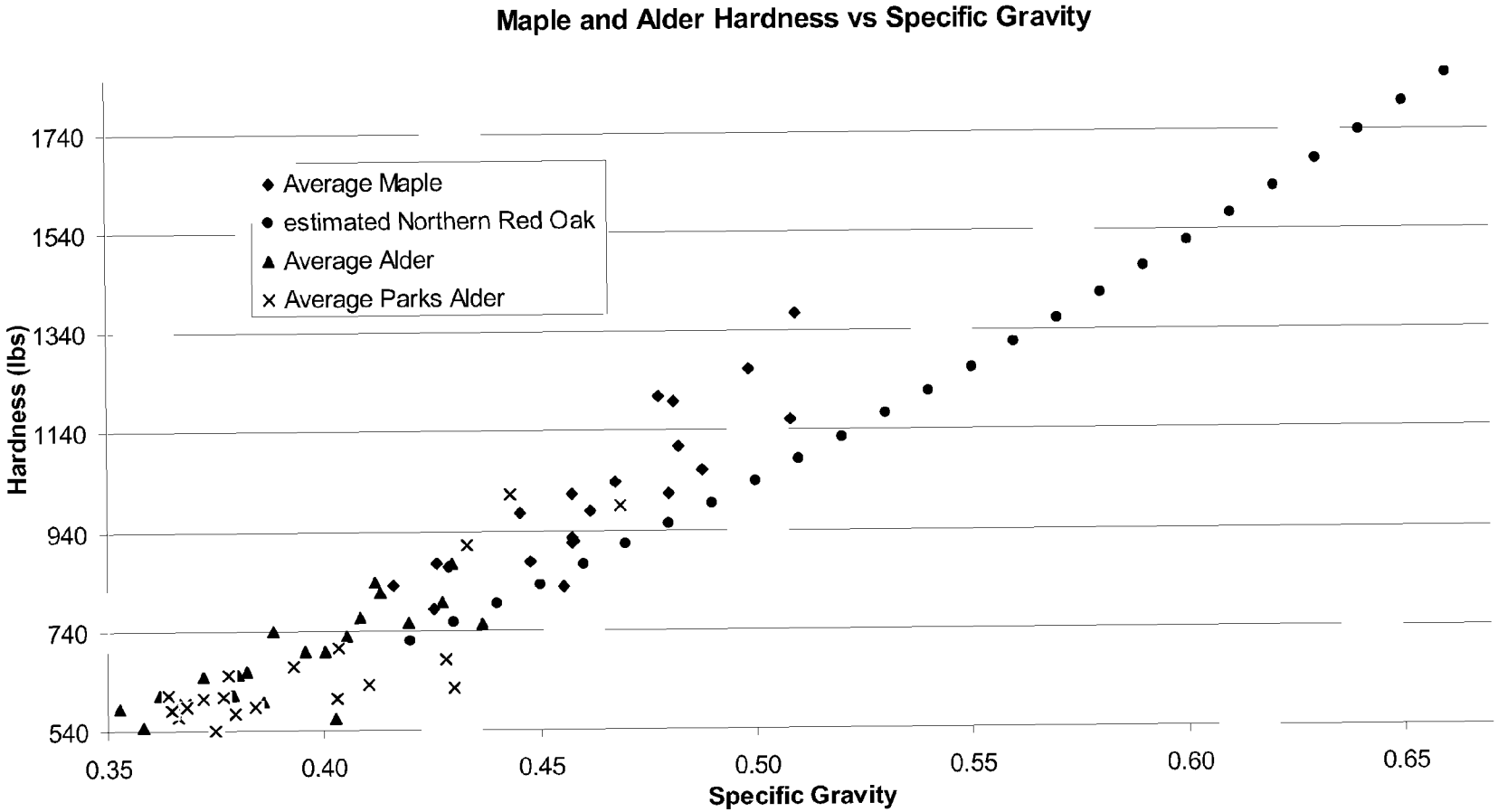
FIG. 1 is a plot of hardness versus specific gravity comparing the hardness of maple and oak to the hardness of red alder.
Figure 2:
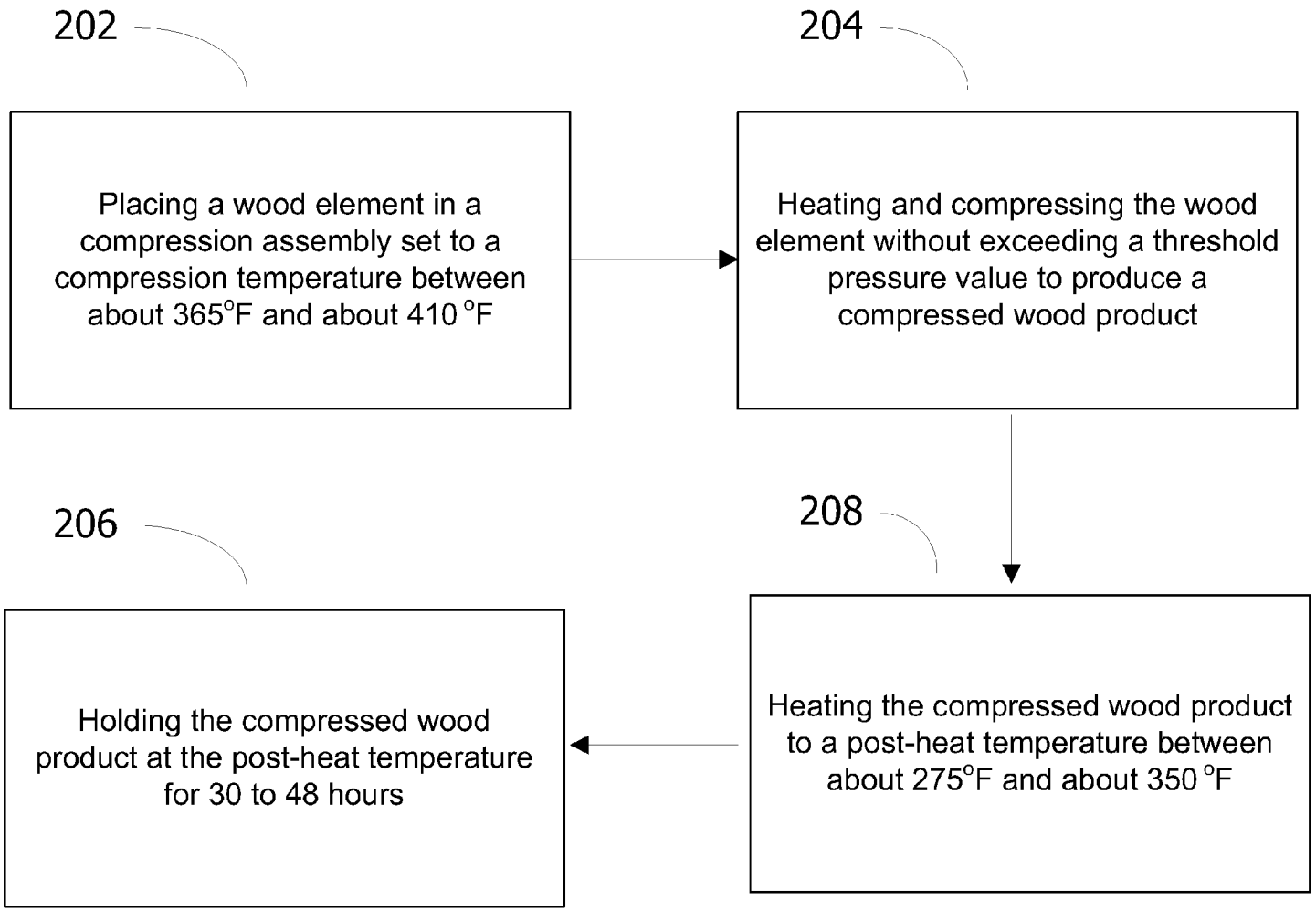
FIG. 2 is a flow chart illustrating a method for enhancing the hardness and dimensional stability of a wood element according to an embodiment of the disclosure.
Figure 3:
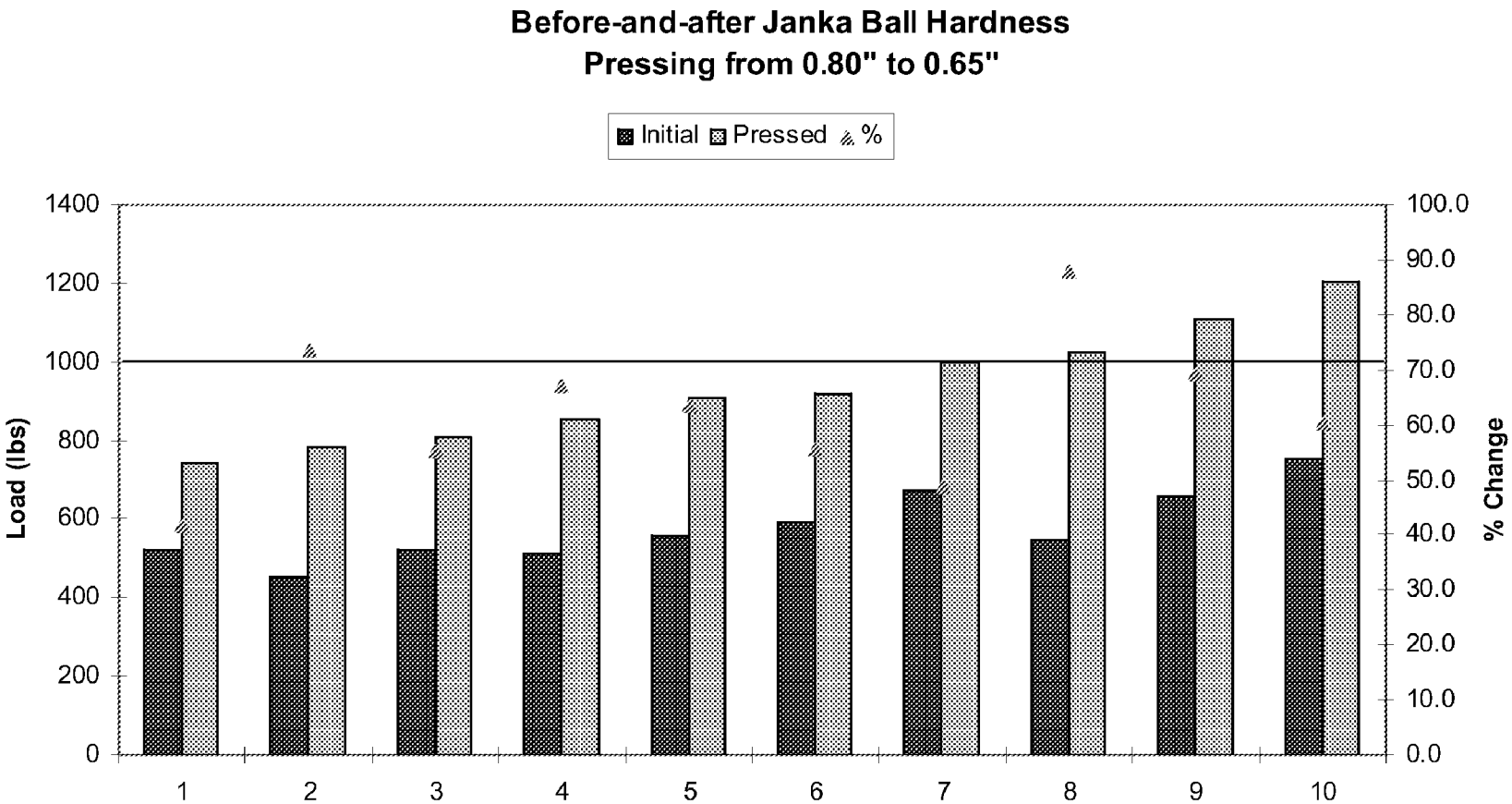
FIG. 3 is a chart showing change in hardness of samples of Red Alder after pressing according to an embodiment of the disclosure.

The disclosure generally describes methods for enhancing the hardness and dimensional stability of a wood element. FIG. 2 illustrates a four-step method according to an embodiment of the disclosure. The first step 202 can include placing a wood element in a compression assembly. The compression assembly can be any conventional compression device known in the art that is capable of applying both heat and pressure. Such devices can include, for example, platen presses, heated rollers or continuous presses, multi-opening and single-opening presses.

Optionally the wood element can be conditioned before performing the first step 202. In one embodiment, the wood element is conditioned to obtain a moisture content between about 8% and about 15%. To obtain a moisture content of 8-10%, the wood is conditioned at about 65% relative humidity (R.H.) and about 20° C. for approximately two weeks. To obtain a moisture content of 12-15%, the wood is conditioned at about 90% R.H. and about 20° C. Alternatively if undried wood (known to those in the art as greenwood) can be placed in a dry kiln and removed when the desired moisture range is obtained.

The second step 204 can involve heating and compressing the wood product to increase densification. If a platen press is used, this can be done by setting the platen temperature to a desired temperature and closing the press on the wood element so as to reduce the its caliper while simultaneously increasing its core temperature. Heating and compressing the wood element mobilizes the lignin and other thermoplastic materials, allowing it to migrate throughout the structure of the wood.

The amount of pressure applied is calculated based on the force necessary to press the wood element to a desired densification target. In red alder, for example, the pressure applied by the compression assembly can range from about 100 psi down to about 450 psi. It is well known to those skilled in the art that there is a linear relationship between density and hardness, irrespective of the species of wood. A desired density target, for example, can be achieving a 10% to 30% increase in density. The pressure is also limited by the compressive strength (or perpendicular to grain strength) of the wood element, which varies by species. Pressure exceeding the "perpendicular to grain compressive strength" in psi is not applied to the wood until the desired core temperature is obtained so that the psi induced on the wood is less than about 500 psi. If the platens are closed prior to reaching the desired core temperature, the pressure can exceed about 750 psi and cause physical damage due to exceeding the perpendicular to grain, compressive strength for this species.

During the second step 204, the wood element can be heated to a compression temperature between about 365° F. and about 410° F. In some embodiments, the compression temperature is raised gradually. Preferably the wood element is heated to a compression temperature of about 365° F. In an embodiment, the core temperature of the wood is monitored while closing the platens to the desired caliper thereby compressing the wood element and increasing its density and hardness. Core temperatures may range form about 290° F. to about 365° F., depending on the content of dense fibrous wood in the wood element known to those skilled in the art as summerwood or latewood.

The compression assembly is closed in a very slow, continuous press cycle so that the compressive strength of the wood species is not exceeded. In an embodiment, the compression assembly applies a pressure of approximately 500 psi for approximately 500 seconds. In some embodiments the compression assembly may apply pressure for approximately 20 minutes. This combination of heating and compression can provide uniform density needed for most applications.

After the second step 204, a compressed wood product is produced which has a higher density than the wood element. Because the density has increased, the hardness has also increased. The compressed wood product can be subsequently removed from the compression assembly and prepared for the third step 206 intended to retain the increase in density and hardness. In some embodiments, the compressed wood product is cooled before the third step 206 is performed.

The third step 206 can involve subsequently heating the compressed wood product to post-compression temperature. Holding the compressed wood product at a post-compression temperature further mobilizes the lignin and helps retain the densification increase gained from the previous steps. This post-compression treatment can also reduce springback and help maintain the dimensional stability of the final product. In an embodiment, the compressed wood product is heated to a post-compression temperature between about 275° F. and about 350° F. Preferably the compressed wood product is heated to a post-compression temperature of about 325° F.

The fourth step 208 can include holding the compressed wood product at the post-compression temperature long enough to allow the lignin to fully migrate throughout the wood's structure and to retain the densification increase from the previous steps. In one embodiment, the compressed wood product is placed in an oven or other heating device and held at the post-compression temperature for about 20 to about 48 hours. Preferably the compressed wood product is held at the post-compression temperature for about 30 hours. During this step, the thermoplastic components of the wood (resins, lignin, moisture) slowly migrate uniformly throughout the wood.

In some embodiments, pressure is not applied to the compressed wood product during the fourth step 208. In some embodiments, the compressed wood product may be clamped while it is in the heating device. After the required period of time has elapsed, the compressed wood product is removed from the oven and a wood product having enhanced and retainable hardness is produced.

The wood product having enhanced hardness may be further processed in any number of ways for particular applications. For example, it may be cut shaped, or applied to other products. The wood product may also undergo various cosmetic procedures including but not limited to staining, varnishing, and other types of finishing, The following examples will serve to illustrate aspects of the present disclosure. The examples are intended only as a means of illustration and should not be construed to limit the scope of the disclosure in any way. Those skilled in the art will recognize many variations that may be made without departing from the spirit of the disclosure.

EXAMPLE 1

Compression Cycle on Red Alter and Effects on Hardness, Density and Dimensional Stability In Example 1, samples of Red Alder were treated using methods according to embodiments of the disclosure. Prior to the treatment, the initial hardness, density, and dimensions of the samples were measured using standard methods. In general the samples in this study were 0.800 inches thick with a density of approximately 29.7 pounds per cubic foot (PCF), with hardness values less than 750. The samples were placed in a hot platen press having a temperature of 395° F. The platens were closed and the caliper was gradually reduced to increase the density of the samples, while avoiding the compressive strength limits of the species as described in the disclosure. At the same time, the core temperature of the samples was gradually increased. The core temperature to which the samples were heated ranged from approximately 250° F. to approximately 300° F.

After the compression cycle, the hardness of the samples were measured using a process known to those skilled in the art as a Janka Ball Test. This test is a standard ASTM International procedure described in detail in the publication *Standard Test Methods for Small Clear Specimens of Timber* (2007) available at http://www.astm.org/Standards/D143.htm, which is hereby incorporated by reference. A standard tool 402 is used to force a ball having a specific diameter (not shown) into various locations on the surface of a sample. The force required to penetrate the surface of the sample to one half of the ball's diameter is recorded. Multiple penetrations are made on various surfaces of the sample and the hardness is derived from the force measurements. The hardness is expressed in a unit known as Janka which is equivalent to pounds-force (lbf).

The treated Red Alder samples were tested using a standard Janka Ball test to determine the change in hardness after compression. The results of the test are shown in the chart in FIG. 3. All of the samples exhibited an increase in hardness after treatment, with some samples exceeding 1000 Janka which is within the range of some very dense hardwoods such as Oak and Cherry.

Figure 4:
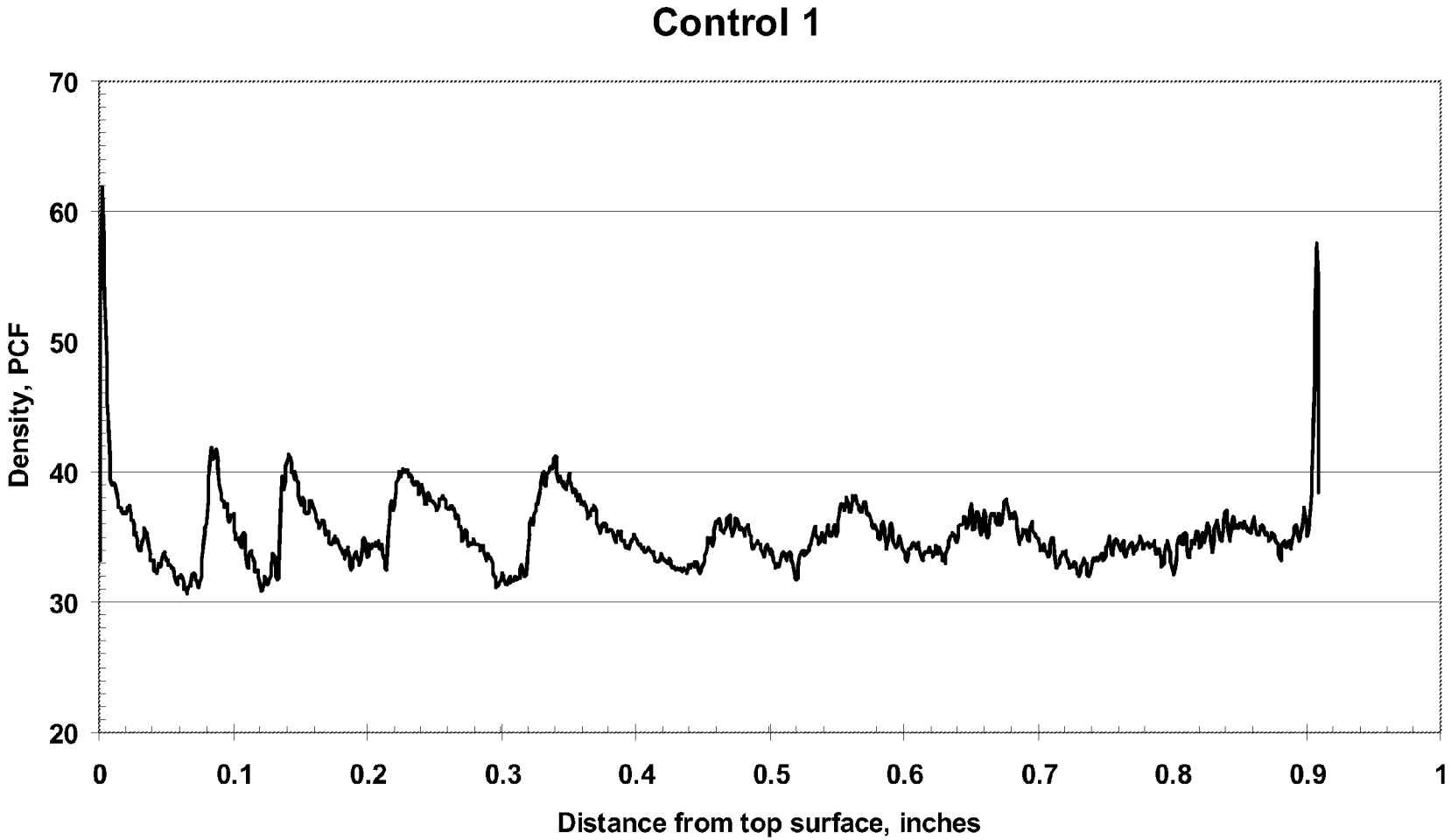
FIG. 4 is a density plot of untreated Red Alder.
Figure 5:
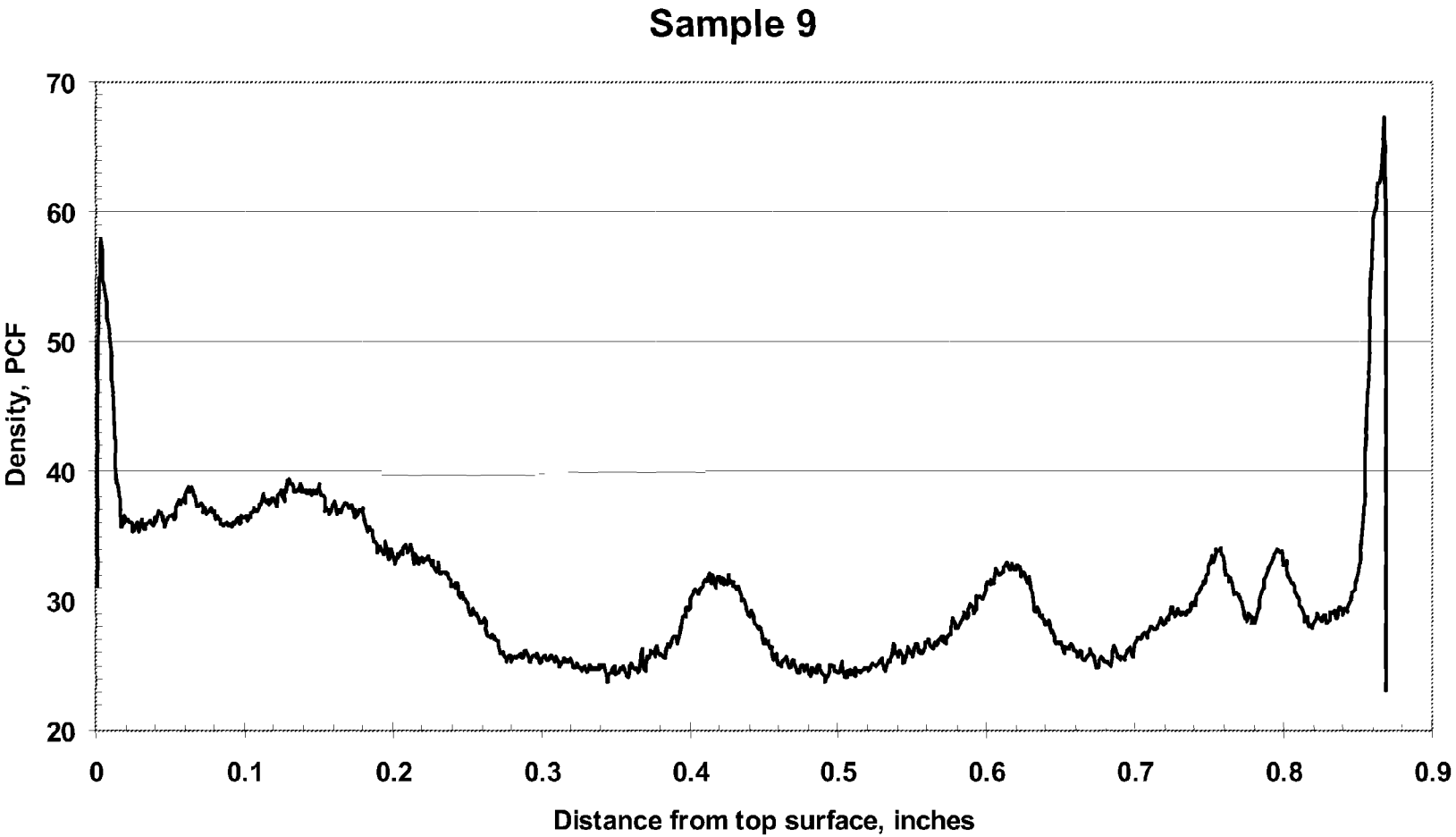
FIGS. 5-7 are density plots of Red Alder treated according to embodiments of the disclosure.
Figure 6:
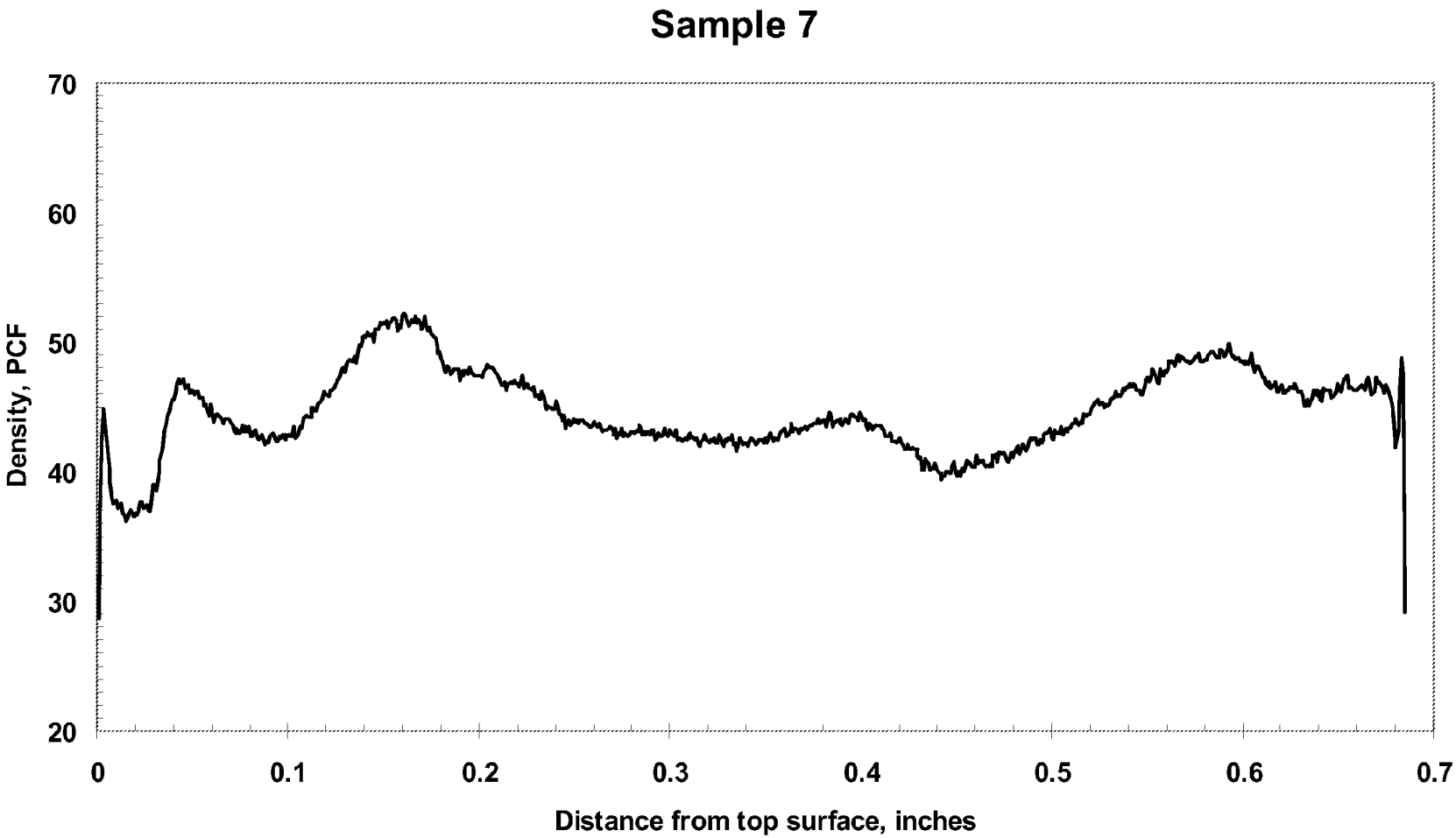
Figure 7:
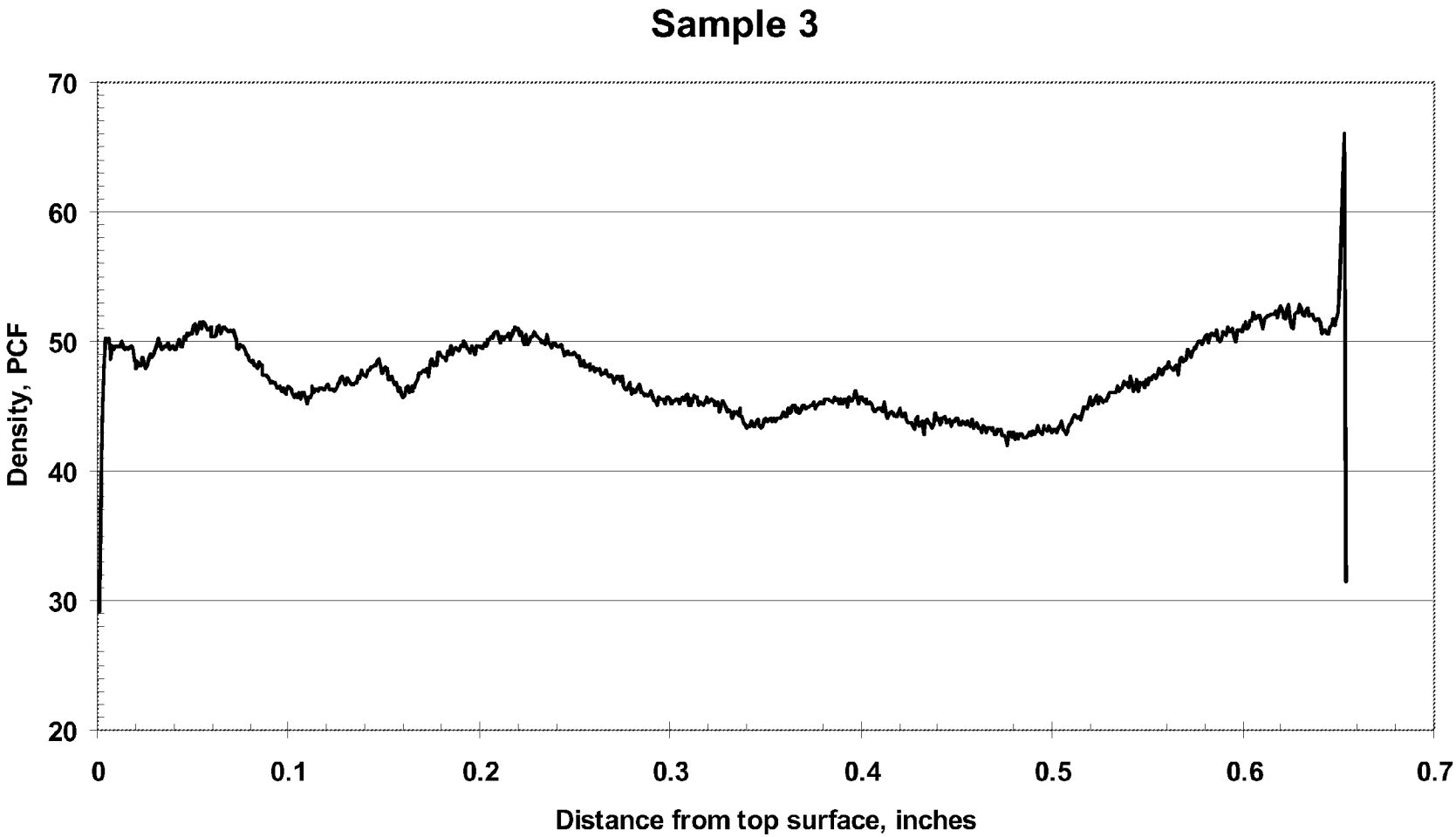

X-ray tests were performed on some of the samples to visualize the density change as a result of treatment. In addition, the same x-rays tests were performed on non-treated samples of Red Alder as a control. FIGS. 4-7 show the density plots of the different samples of Red Alder. FIG. 4 shows a control plot of the density measurement of an untreated sample. FIG. 5 shows plot of the density measurement of a sample treated according to embodiments of the disclosure that was heated to a core temperature of 250° F. FIG. 6 shows plot of the density measurement of a sample treated according to embodiments of the disclosure that was heated to a core temperature of 282° F. FIG. 7 shows plot of the density measurement of a sample treated according to embodiments of the disclosure that was heated to a core temperature of 300° F. It is apparent that the treated wood has a higher and more uniform density than the control wood. In all cases, when the boards were subjected to a gradual press process, the density increased. Heating to a core temperature of approximately 300° F. results in a sample with the highest and most uniform density. It should be noted that boards pressed having less than 4% moisture did experience an increase in density.

EXAMPLE 2

Compression Cycle and Post-Compression Treatment on Red Alder and Effects on Hardness and Dimensioanl Stability In Example 2, nineteen samples of Red Alder were treated using methods according to embodiments of the disclosure. The procedures, sample dimensions, and initial conditions were similar to those described in Example 1. FIG. 10 shows a typical compression cycle schedule used in this example.

After the compression cycle, four of the samples were placed in an oven and held at a post-compression temperature of 275° F. for time periods ranging from about 48 to 120 hours. After the post-compression treatment, all nineteen samples were subjected to a standard test known as AITC #T110 described in AITC 200-2004 *Manufacturing Quality Control Systems Manual* on pages 47-48, which is hereby incorporated by reference. According to this process, the treated samples were subjected to a vacuum-pressure-soak cycle in an autoclave followed by a period of drying in an oven. Table 1 summarizes the results from the AITC #T110 test for the samples which did not undergo the post-compression treatment (samples 1-15).

TABLE 1

| Sample Number | Platen Temperature (° F.) | Closures | Final Core Temperature (° F.) | Total Press Time (seconds) | Average Thickness Change |
|---|---|---|---|---|---|
| 1 | 365 | 4 | 282 | 500 | 22.5% |
| 2 | 375 | 4 | 289 | 500 | 21.4% |
| 3 | 385 | 4 | 306 | 500 | 10.6% |
| 4 | 385 | 4 | 300 | 500 | 21.5% |
| 5 | 395 | 4 | 298 | 500 | 25.6% |
| 6 | 405 | 4 | 314 | 800 | 29.4% |
| 7 | 385 | 4 | 312 | 800 | 28.0% |
| 8 | 385 | 4 | 306 | 800 | 27.3% |
| 9 | 385 | 4 | 248 | 800 | 29.4% |
| 10 | 385 | 4 | 337 | 920 | 25.2% |
| 11 | 385 | 4 | 325 | 920 | 29.0% |
| 12 | 385 | 4 | 286 | 920 | 28.5% |
| 13 | 385 | 4 | 335 | 920 | 27.3% |
| 14 | 385 | 4 | 308 | 920 | 24.1% |
| 15 | 385 | 4 | 340 | 920 | 35.6% |

Table 2 summarizes the results from the AITC #T110 test for the samples which did undergo the post-compression treatment (samples 16-19) including the duration of the treatment in hours.

TABLE 2

| Sample Number | Platen Temperature (° F.) | Closures | Final Core Temperature (° F.) | Duration (hours) | Total Press Time (seconds) | Average Thickness Change |
|---|---|---|---|---|---|---|
| 16 | 385 | 4 | 308 | 48 | 920 | 10.6% |
| 17 | 385 | 4 | 335 | 96 | 920 | 5.9% |
| 18 | 385 | 4 | 340 | 120 | 920 | 6.4% |
| 19 | 385 | 4 | 306 | 120 | 800 | 8.6% |

The average change in thickness for the samples (samples 1-15) that were not subjected to the post-compression treatment was 26.0%. The average change in thickness for the samples that were treating according to the post-compression procedure (samples 16-19) was 7.9%. Thus, wood subjected to a post-compression treatment is expected to exhibit significantly less swelling than wood that is not treated according to some embodiments of the disclosure.

EXAMPLE 3

Compression Cycle, Post-Compression Treatment, and Clamping on Red Alder and Effects on Dimensional Stability In Example 3, samples of Red Alder were treated using methods according to embodiments of the disclosure. The procedures, sample dimensions, and initial conditions were similar to those described in Examples 1 and 2. After the compression cycle, the samples were placed in an oven and heated to 325° F. for a period of time ranging from about 6 hours to about 48 hours. During the post-compression treatment some of the samples were clamped.

Figure 8:
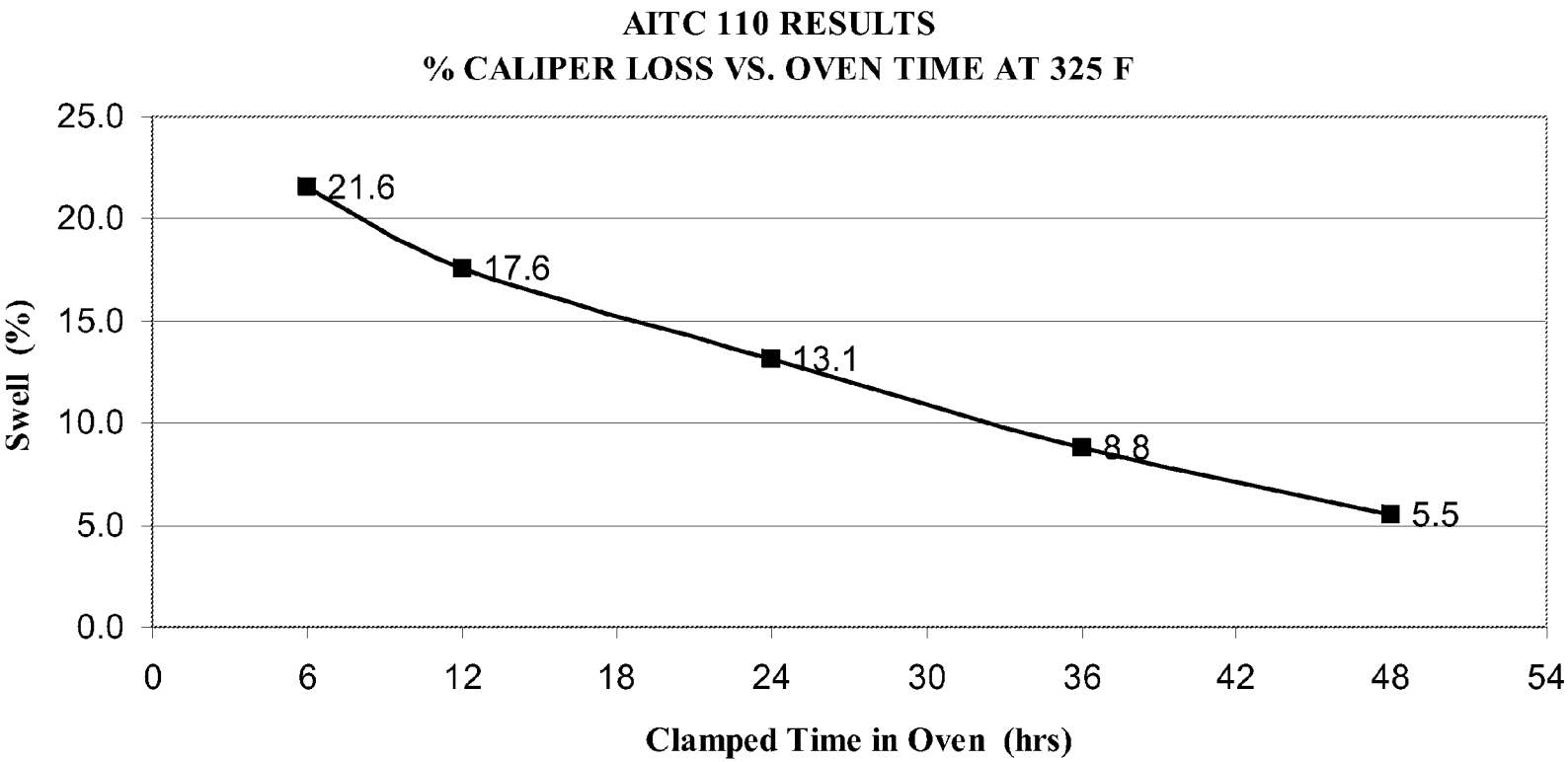
FIG. 8 is a plot of percentage of swelling vs. post-cure time at 325° F.

After the post-compression treatment, the samples were subjected to the AITC #T110 test described in Example 2. FIG. 8 shows a plot of percentage of swell based on caliper loss versus clamped time in the oven. Each data point represents an average of two samples. One sample was not clamped and was held at the oven for approximately 24 hours. As shown in the Figure, after approximately 30 hours of clamped time in the oven the swell percentage can be reduced to approximately 10%. In some examples, a swell percentage of approximately 5% was obtained, which is close to the swell percentage of natural wood. Thus, some embodiments of the disclosure may enable treated wood to exhibit dimensional stability characteristics similar to those of natural wood.

The examples demonstrate that that the disclosure provides an effective alternative to current chemical and mechanical methods for enhancing wood hardness and dimensional stability. Methods according to some embodiments of the disclosure are expected to increase the hardness of various types of wood without adversely affecting other properties such as abrasion resistance, refinishability, workability, and color modification. In addition, methods according to embodiments of the disclosure may be performed with conventional equipment and do not pose unnecessary health, safety, and environmental risks.

From the foregoing, it will be appreciated that the specific embodiments of the disclosure have been described herein for purposes of illustration, but that various modifications may be made without deviating from the disclosure. For example, the steps described in the disclosure may be performed in a different order or may be altered in ways that would be apparent to those of ordinary skill in the art. Additionally, aspects of the disclosure described in the context of particular embodiments may be combined or eliminated in other embodiments.

Further, while advantages associated with certain embodiments of the disclosure may have been described in the context of those embodiments, other embodiments may also exhibit such advantages, and not all embodiments need necessarily exhibit such advantages to fall within the scope of the disclosure. Accordingly, the invention is not limited except as by the appended claims.

We claim:

1. A method for enhancing hardness and dimensional stability of a wood element belonging to a species, the method comprising:

placing the wood element in a compression assembly set to a compression temperature between about 365° F. and about 410° F.;

heating and compressing the wood element without exceeding a threshold pressure value to produce a compressed wood product;

heating the compressed wood product to a post-compression temperature between about 275° F. and about 350° F.; and holding the compressed wood product at the post-compression temperature for 30 to about 48 hours;

wherein the threshold pressure value is based on the species to which the wood element belongs.

2. The method of claim 1 wherein holding the compressed wood product at the post-compression temperature for about 30 to about 48 hours further comprises:

placing the compressed wood product in a heating device; and clamping the compressed wood product.

3. The method of claim 1, further comprising conditioning the wood to obtain a moisture content between about 8% and about 15% prior to compressing the wood element.

4. The method of claim 1 wherein compressing the wood element comprises placing the wood element in a compression assembly, the compression assembly being selected from the group consisting of a platen press, heated rollers, continuous presses, multi-opening presses and single opening presses.

5. The method of claim 1 wherein the species is selected from the group consisting of Red Alder, Eucalyptus, and Pacific Coast Maple.

6. A method for producing a wood product having enhanced hardness comprising:

conditioning a wood element to obtain a moisture content of about 8% to about 15%;

placing the wood element in a compression assembly set to a compression temperature between about 365° F. and about 410° F.;

compressing the wood element without exceeding a threshold pressure value to form a compressed wood product by:

reducing the wood element's caliper under pressure; and simultaneously increasing a core temperature of the wood element;

removing the compressed wood product from the compression assembly;

heating the compressed wood product to a post-compression temperature between about 275° F. and about 350° F.;

placing the compressed wood product in an oven;

clamping the compressed wood product; and holding the compressed wood product at the post-compression temperature for about 30 to about 48 hours to produce a wood produce having enhanced hardness.

7. The method of claim 6 wherein the wood element, the compressed wood product, and the wood product having enhanced hardness are not treated with a chemical component or subjected to a chemical process.

8. The method of claim 6 wherein the wood product having enhanced hardness has a hardness of greater than 1000 Janka based on a Janka Ball Test.

9. The method of claim 6 wherein the wood element belongs to a species, the species being selected from the group consisting of Red Alder, and Eucalyptus and Pacific Coast Maple.

10. The method of claim 1 wherein compressing the wood element comprises placing the wood element in a compression assembly, the compression assembly being selected from the group consisting of a platen press, heated rollers, continuous presses, multi-opening presses and single opening presses.

* * * * *